US009700783B2

(12) United States Patent
Hurtado et al.

(10) Patent No.: US 9,700,783 B2
(45) Date of Patent: Jul. 11, 2017

(54) INDIVIDUALLY TRIPPABLE AND RESETTABLE DROP TARGET

(71) Applicant: JJ PINBALL LLC, Lakewood, NJ (US)

(72) Inventors: Roberto Hurtado, Lincolnwood, IL (US); Keith P. Johnson, South Elgin, IL (US)

(73) Assignee: JJ PINBALL LLC, Lakewood, NJ (US)

( * ) Notice: Subject to any disclaimer, the term of this patent is extended or adjusted under 35 U.S.C. 154(b) by 6 days.

(21) Appl. No.: 14/743,429

(22) Filed: Jun. 18, 2015

(65) Prior Publication Data

US 2015/0367228 A1 Dec. 24, 2015

Related U.S. Application Data

(60) Provisional application No. 62/015,129, filed on Jun. 20, 2014.

(51) Int. Cl.

| | |
|---|---|
| ***A63D 5/08*** | (2006.01) |
| ***F41J 5/14*** | (2006.01) |
| ***F41J 5/18*** | (2006.01) |
| ***F41J 5/04*** | (2006.01) |

(52) U.S. Cl.
CPC *A63D 5/08* (2013.01); *F41J 5/04* (2013.01); *F41J 5/14* (2013.01); *F41J 5/18* (2013.01)

(58) Field of Classification Search
CPC ..... F41J 5/18; F41J 5/04; F41J 5/14; A63F 9/0204
USPC ..... 273/391, 392
See application file for complete search history.

(56) References Cited

U.S. PATENT DOCUMENTS

| | | | | |
|---|---|---|---|---|
| 4,249,736 | A * | 2/1981 | Rosenthal | A63D 5/08 273/127 R |
| 4,257,604 | A * | 3/1981 | Grabel | A63F 7/3065 273/127 R |
| 4,460,175 | A * | 7/1984 | Krynski | A63F 7/305 200/61.11 |
| 4,540,182 | A * | 9/1985 | Clement | F41J 7/04 273/391 |
| 4,804,186 | A * | 2/1989 | Moravec | A63F 7/3065 273/121 A |
| 5,788,245 | A * | 8/1998 | Hada | A63F 9/0204 273/392 |
| 2011/0248447 | A1* | 10/2011 | Yang | F41J 1/10 273/355 |
| 2015/0001796 | A1* | 1/2015 | Stellenberg | A63F 3/0052 273/121 A |

* cited by examiner

*Primary Examiner* — Aarti B Berdichevsky
*Assistant Examiner* — Rayshun Peng
(74) *Attorney, Agent, or Firm* — Graham Curtin, P.A.

(57) ABSTRACT

A drop target bank assembly including: a plurality of drop target units mounted next to each other on a drop target bank bracket; wherein each of the plurality of drop target units includes: a target; a trip mechanism; a reset mechanism; and a sensor; wherein the trip mechanism is configured to move the target from a first position to a second position; wherein the reset mechanism is configured to move the target from the second position to the first position; wherein the sensor is configured to detect whether the target is at the first or second position; and wherein the trip mechanism and the reset mechanism in a drop target unit are individually activated independent of other drop target units.

14 Claims, 11 Drawing Sheets

INDIVIDUALLY TRIPPABLE AND RESETTABLE DROP TARGET

CROSS REFERENCE TO RELATED APPLICATIONS

This application claims priority to U.S. application Ser. No. 62/015,129, filed Jun. 20, 2014. The entire contents of U.S. application Ser. No. 62/015,129 are hereby incorporated by reference.

FIELD OF THE INVENTION

The present disclosure relates to arcade entertainment machines, and more particularly to a drop target incorporated into a pinball machine.

BACKGROUND

Drop targets are individual targets in a pinball machine that can be knocked down by the user using a pinball. Once a drop target is downed, a coil resets the drop target to an "up" position after a predetermined period of time. Drop targets can be set up as isolated or as groups, or banks, of drop targets, with the goal being to knock down all targets of a bank. When all drop targets of a bank are in a "down" position, a single coil raises all targets in the bank up simultaneously.

Drop targets can also be configured such that a game can lower some of the targets based on certain rules in the game. For example, in a pinball game based on the game of poker (see, e.g., Gottlieb's 1977 Jacks Open), after making certain sequences, only the "royal flush" would be available by resetting up all of the drop targets, then collectively retracting the drop targets that do not make up the royal flush cards.

With the advent of computer-driven solid state pinballs, games can "remember" what targets had been previously hit and dropped (see, e.g., Bally's 1980 8-Ball Deluxe). To accomplish this, a game resets all drop targets to the up position, then uses individual "trip" coils to knock down the drop targets which had been previously hit. This setup is called "individual trippable." With the introduction of Williams' 1981 Jungle Lord, for example, drop target technology allows drop targets to be tripped all at once and individually reset up. This setup is called "individual resettable."

Unique play modes are important to keeping a player's interest in a game over time. The individual trippable coils may be used for remembering previous targets, but for interactive features, they tend to fall short. For example, only the desired target may be able to move up. Thus, there is a need for a kind of target bank that can sustain a player's interest in a more complicated and interactive scenario, such as a "wall" with a moving hole for the player to shoot.

SUMMARY

An embodiment of the present disclosure provides a drop target bank assembly including: a plurality of drop target units mounted next to each other on a drop target bank bracket; wherein each of the plurality of drop target units includes: a target; a trip mechanism; a reset mechanism; and a sensor; wherein the trip mechanism is configured to move the target from a first position to a second position; wherein the reset mechanism is configured to move the target from the second position to the first position; wherein the sensor is configured to detect whether the target is at the first or second position; and wherein the trip mechanism and the reset mechanism in a drop target unit are individually activated independent of other drop target units.

Another embodiment of the present disclosure provides a drop target system including: one or more drop target assemblies; a processor; and a drive circuit; wherein each of the one or more drop target assemblies comprises a plurality of drop target units mounted next to each other on a drop target bank bracket; wherein each of the plurality of drop target units includes: a target; a trip mechanism; a reset mechanism; and a sensor; wherein the trip mechanism is configured to move the target from a first position to a second position; wherein the reset mechanism is configured to move the target from the second position to the first position; wherein the sensor is configured to detect whether the target is at the first or second position; and wherein the trip mechanism and the reset mechanism in a drop target unit are individually activated independent of other drop target units; wherein the processor is configured to receive a signal from the sensor and to control the drive circuit based on the signal or a program, such that the drive circuit individually actives the trip mechanism and the reset mechanism.

Another embodiment of the present disclosure provides a method of operating a drop target bank assembly that includes a plurality of drop target units mounted next to each other on a drop target bank bracket; wherein each of the plurality of drop target units comprises: a target; a trip mechanism; a reset mechanism; and a sensor; the method including: receiving from the sensor a signal indicating whether the target is at a first position or a second position; individually activating the trip mechanism to move the target from the first position to the second position or activating the reset mechanism to move the target from the second position to the first position based on the signal or a program.

DETAILED DESCRIPTION OF THE PREFERRED EMBODIMENTS

Figure 1:
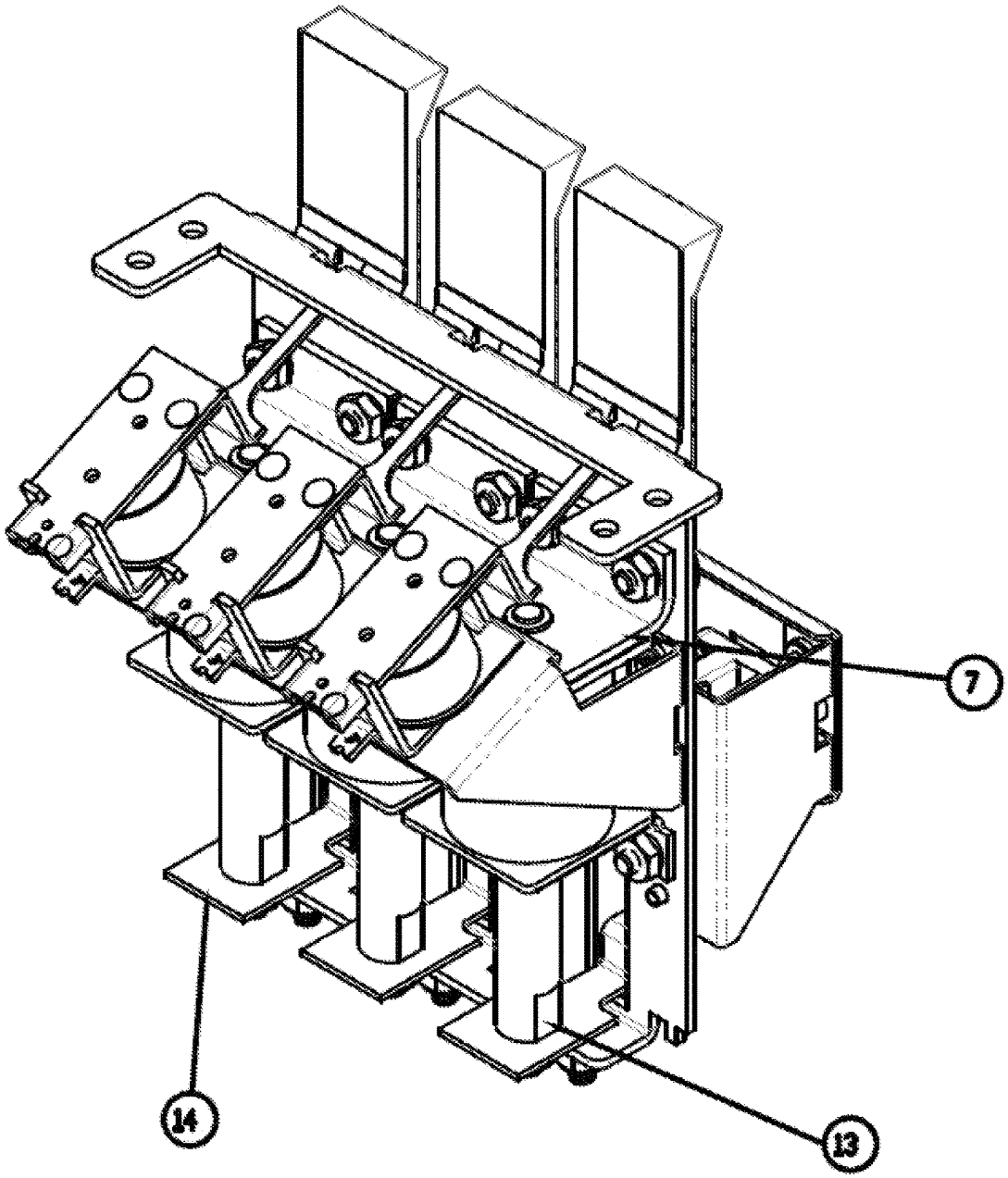
FIG. 1 is perspective view of a bank of individually trippable and resettable drop targets in accordance with an embodiment of the present disclosure.
Figure 2:
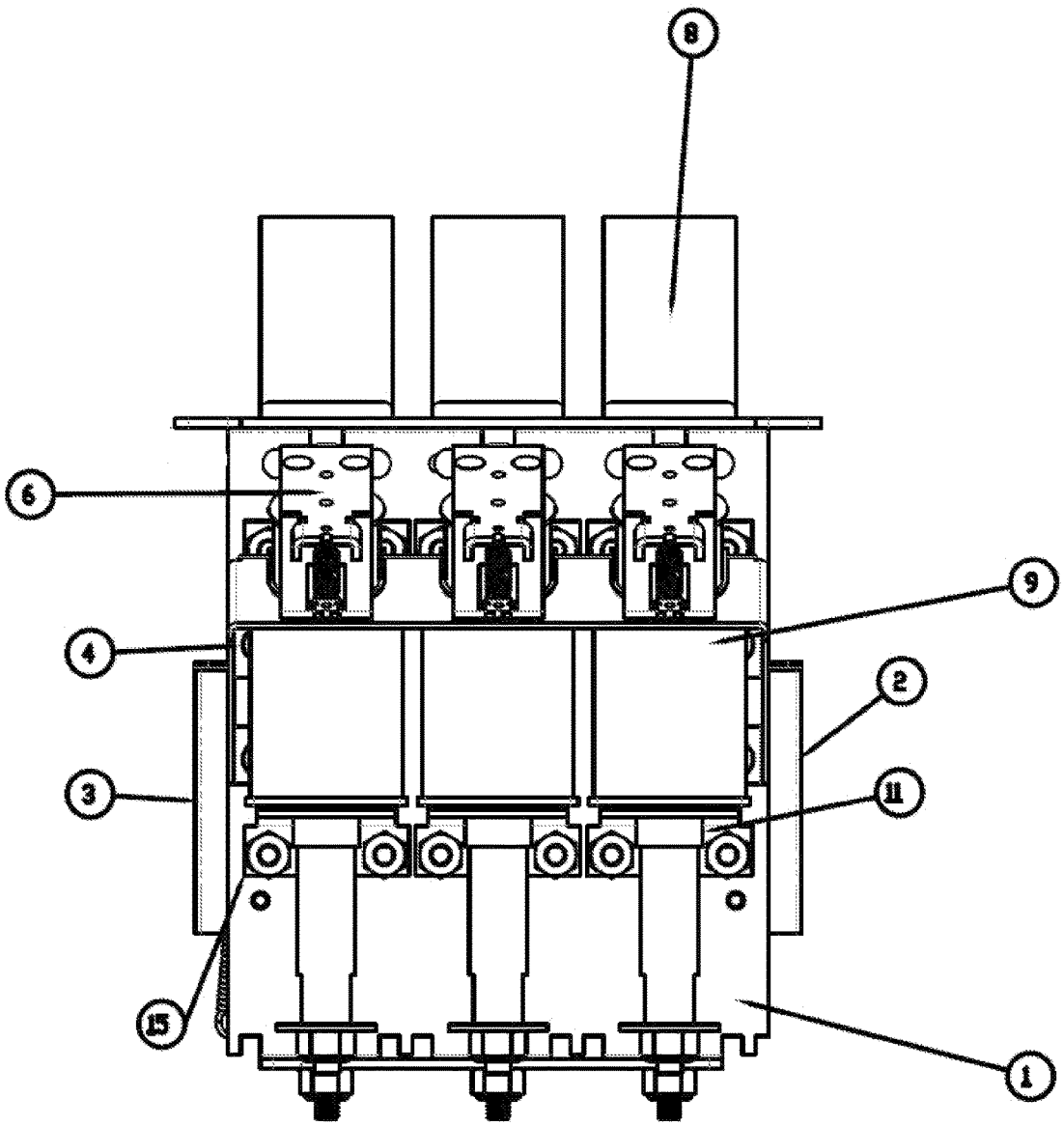
FIG. 2 is a front view of a bank of drop targets.
Figure 3:
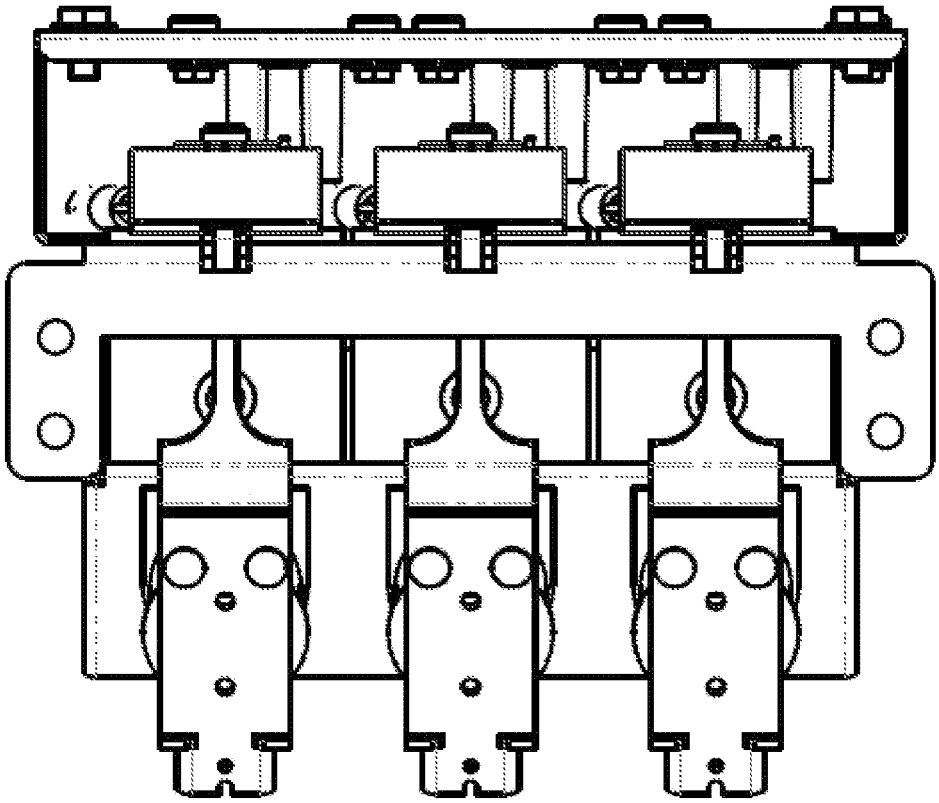
FIG. 3 is a top view of a bank of drop targets.

The description of illustrative embodiments according to principles of the present disclosure is intended to be read in connection with the accompanying drawings, which are to be considered part of the entire written description. In the description of embodiments of the disclosure disclosed herein, any reference to direction or orientation is merely intended for convenience of description and is not intended in any way to limit the scope of the present disclosure. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the disclosure are illustrated by reference to the exemplified embodiments. Accordingly, the disclosure expressly should not be limited to such exemplary embodiments illustrating some possible non-limiting combination of features that may exist alone or in other combinations of features; the scope of the disclosure being defined by the claims appended hereto.

This disclosure describes the best mode or modes of practicing the disclosure as presently contemplated. This description is not intended to be understood in a limiting sense, but provides an example of the disclosure presented solely for illustrative purposes by reference to the accompanying drawings to advise one of ordinary skill in the art of the advantages and construction of the disclosure. In the various views of the drawings, like reference characters designate like or similar parts.

It is important to note that the embodiments disclosed are only examples of the many advantageous uses of the innovative teachings herein. In general, statements made in the specification of the present application do not necessarily limit any of the various claimed disclosures. Moreover, some statements may apply to some inventive features but not to others. In general, unless otherwise indicated, singular elements may be in plural and vice versa with no loss of generality.

One embodiment of a drop target bank in accordance with the present disclosure is illustrated in FIGS. 1-5, wherein non-limiting descriptions of the reference numbers illustrated in the FIGS. are as follows:

1—three-bank drop target bracket;
2—right opto plate bracket;
3—left opto plate bracket;
4—trip coil array bracket;
5—opto array plate;
6—drop target trip coil assembly;
7—drop target stop bracket assembly;
8—drop target;
9—drop target coil;
10—single target stop;
11—tubing coil;
12—extension spring;
13—drop target plunger;
14—drop target reset bracket;
15—coil retaining bracket;
16—shaft e-ring; and
17—compression spring.

FIGS. 1-5 show a three-bank individually trippable and resettable drop target assembly according to an embodiment. In this embodiment, three individually trippable and resettable drop target units are mounted side by side onto a three-bank drop target bracket 1. The advantage of mounting the three target units to the bracket 1 allows the drop targets to be next to each other, as close as, for example, approximately 3/16 inch. In contrast, a typical target bank having individual target assemblies put together would have an unappealing gap as large as 5/8 inch, due to their construction and footprints. Note that although an example of 3-bank assembly is shown, it is contemplated that any number of target units may be used as desired by the game play designs.

Figure 4:
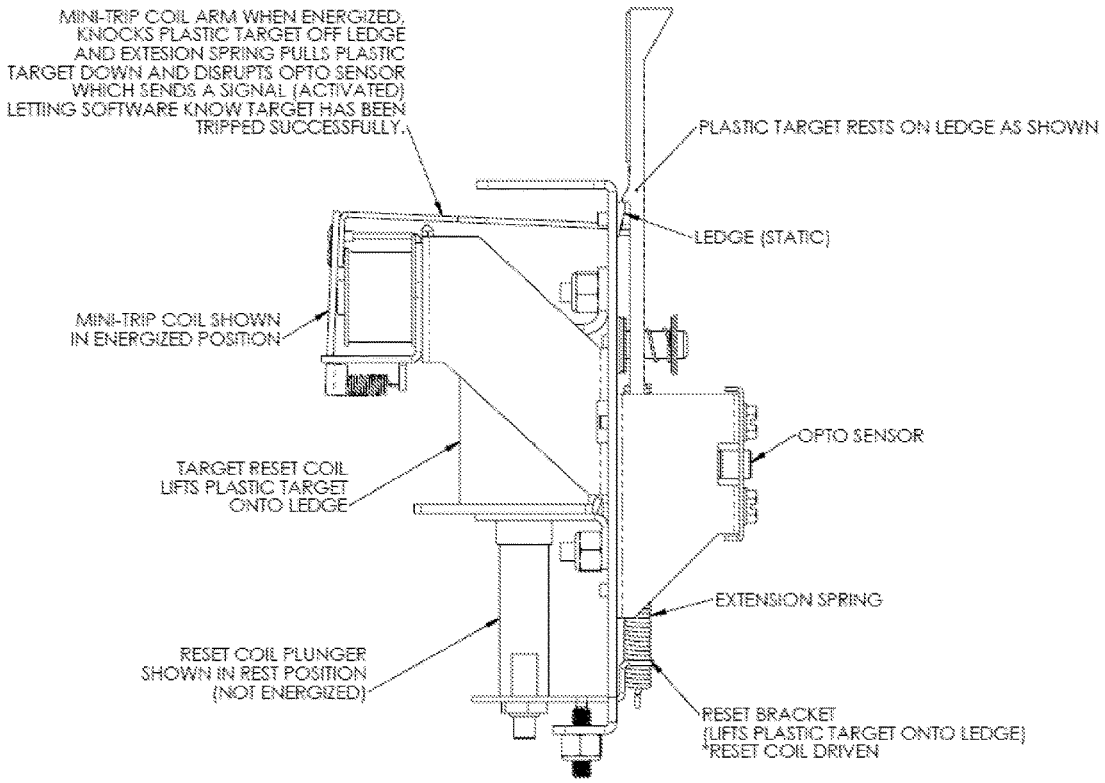
FIG. 4 is a side view of a bank of drop targets.
Figure 5:
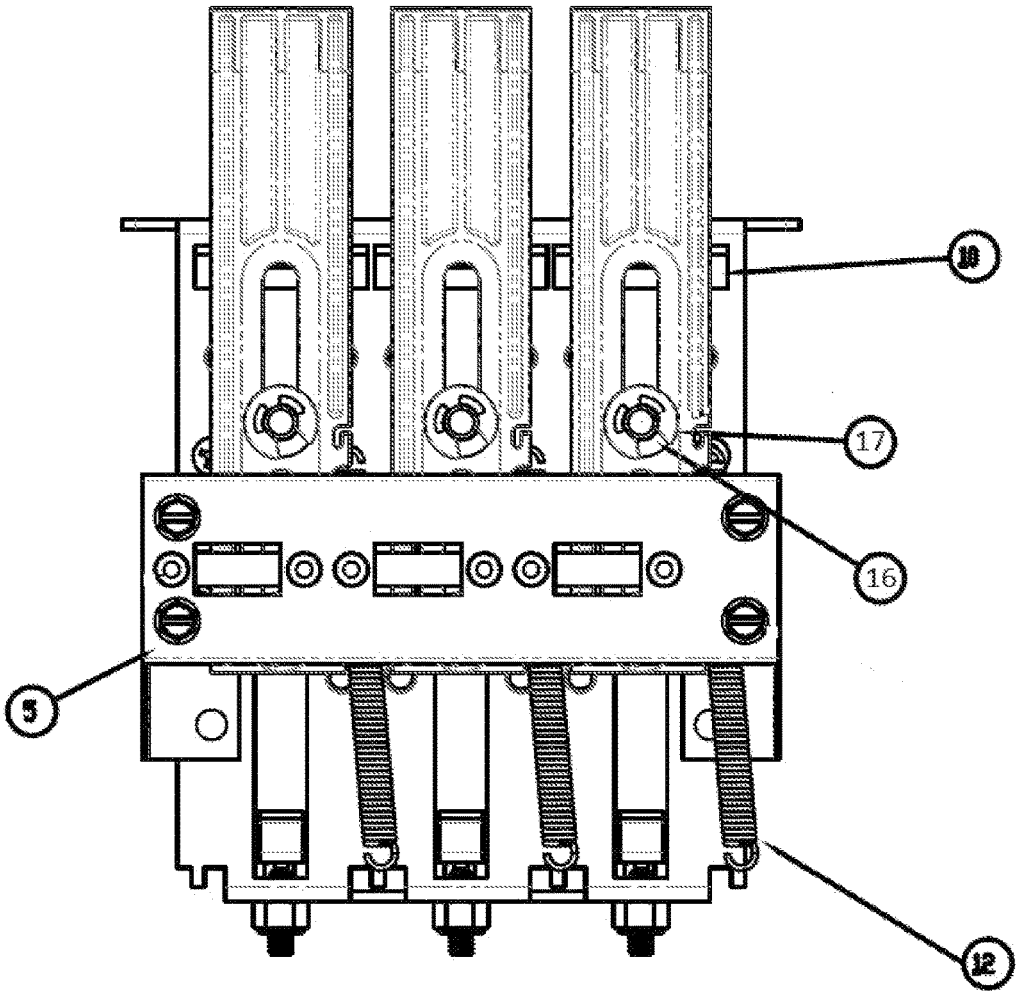
FIG. 5 is a rear view of a bank of drop targets.

As shown in FIG. 4, the drop target 8 rests on a ledge or target stop 10 when it is in the up position. The drop target 8 may be elongated and may be made of any material, such as, for example, plastic. When the drop target assembly is mounted on a playing area, the drop target 8 may move between an elevated position and a recessed position. Without loss of generality, the elevated position may also be referred to as "up" or "first" position; and the recessed position may also be referred to as "down" or "second" position in this document. During play, when a pinball hits the drop target 8, the drop target 8 is knocked off the ledge, and the drop target 8 is pulled down by an extension spring 12. A sensor detects the drop target 8 being pulled down and generates a signal indicating that the pinball has successfully hit the target. Although the figures show that the sensor is an optical sensor in one example embodiment, other types of sensors, such as a mechanical switch, that can detect the position of the drop target 8 are also contemplated.

In each drop target unit, the drop target 8 can be tripped by a tripping mechanism. The tripping mechanism includes a trip coil, which, when energized by an electric current, actuates a trip coil arm to push the target off the ledge. Once off the ledge, the drop target 8 can then be pulled down by the extension spring 12.

Also in each drop target unit, there is a reset mechanism to reset the drop target from the "down" position to the "up" position. The reset mechanism includes a reset coil, which, when energized by an electric current, pulls a reset coil plunger into the coil. A reset bracket is mounted to the plunger, and thus the reset bracket is moved up together with the plunger. As a result, the reset bracket raises the drop target to an elevated position, and the drop target rests on the ledge.

Figure 6:
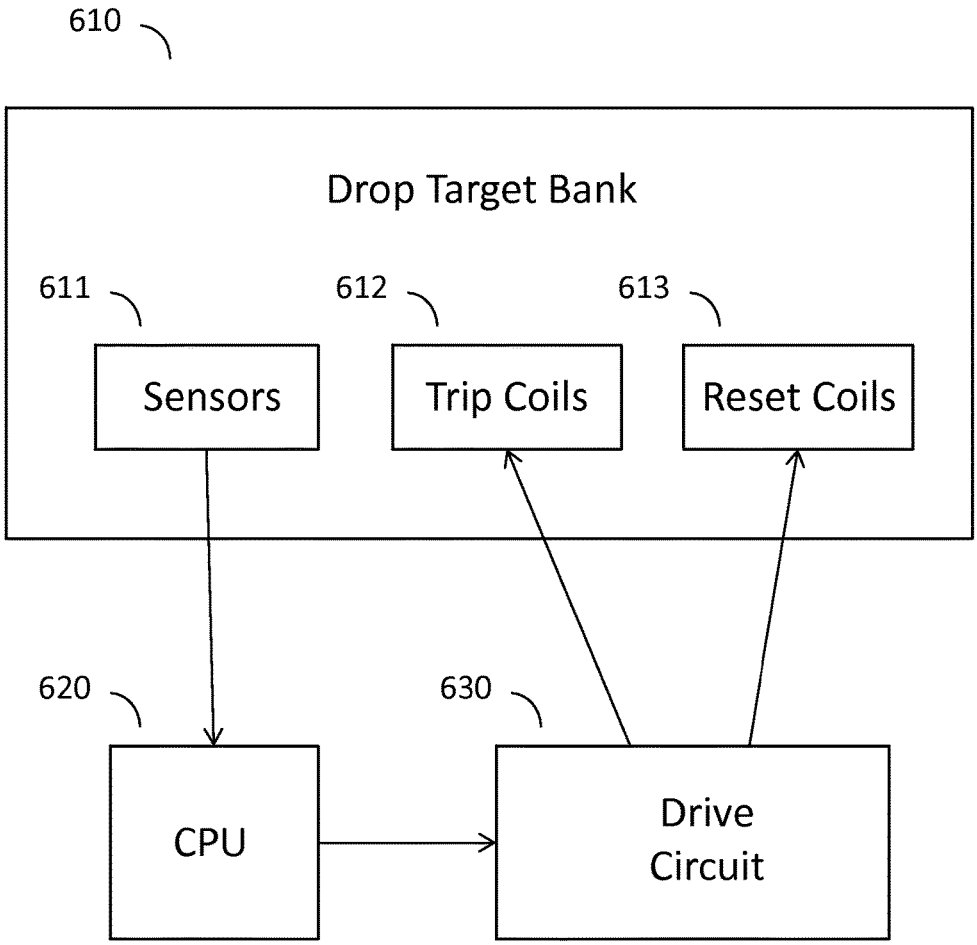
FIG. 6 is a system of individually trippable and resettable drop targets in accordance with an embodiment.

As shown in FIG. 6, each of trip coils 612 and each of the reset coils 613 in a drop target bank 610 is energized by an electric current from a drive circuit 630. The drive circuit 630 is controlled by a CPU 620. The CPU 620 receives signals from the sensors 611 so that CPU 620 knows whether each of the drop targets is in the "up" state or "down" state. A computer executable program is executed in the CPU 620 to control the drive circuit 630, so that the trip coils 612 and reset coils 613 are energized at a predetermined time sequence so as to simulate a desired dynamic movement of the targets.

Figure 7:
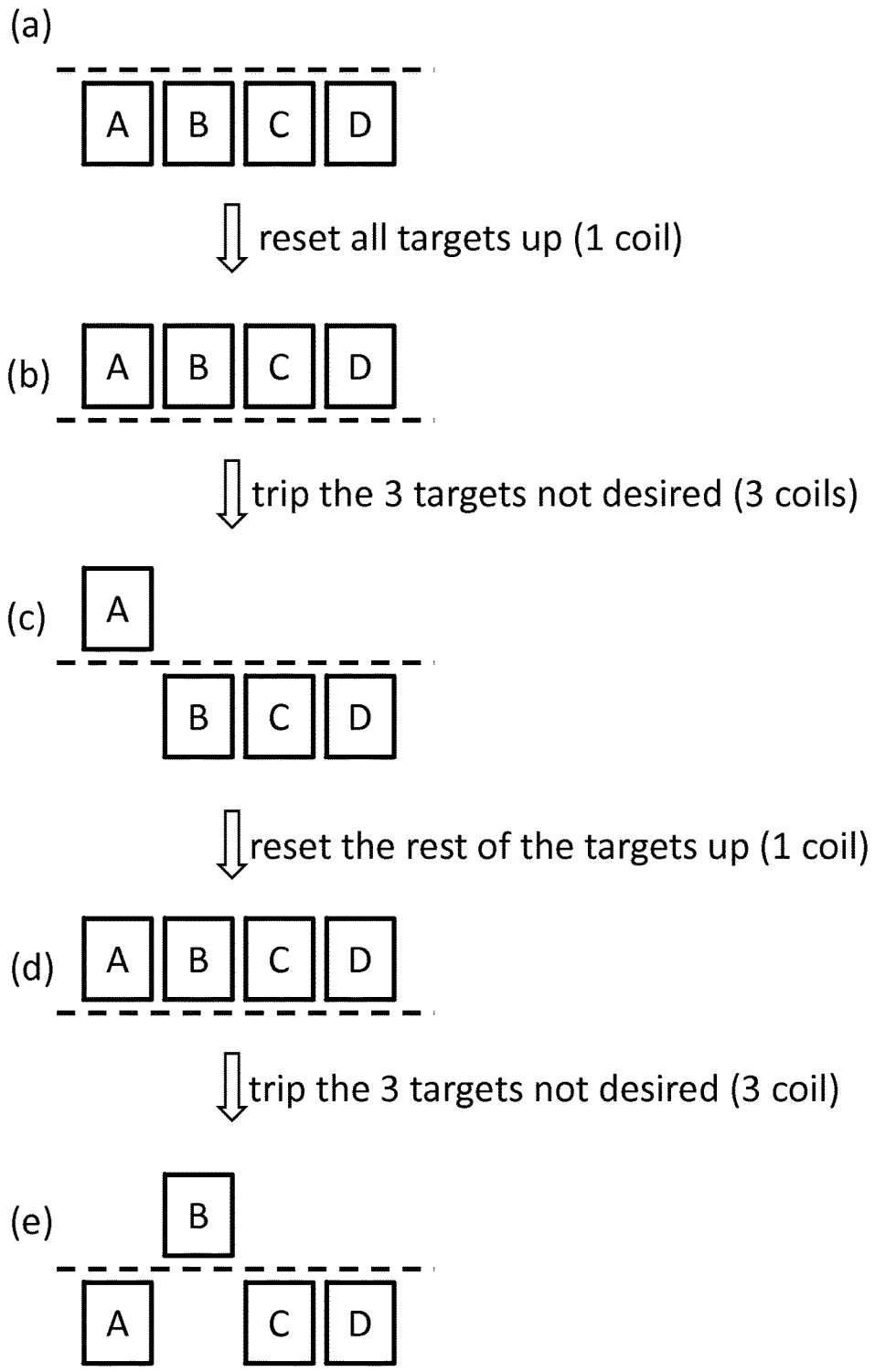
FIG. 7 is an example sequence of operations of a bank of individually trippable drop targets to simulate a movement of the targets.

To illustrate the unique advantage of a bank of individually trippable and resettable drop targets in accordance with an embodiment of the present disclosure, a game play, in which a target movement is simulated in a bank of four targets, is used as a non-limiting example. FIG. 7 illustrates the steps required to simulate a movement of the target from position A to position B using a traditional bank of individually trippable drop targets. To simulate a target moving across, a combination of "reset all targets" and "trip non-desired target" operations is performed. Where all targets begin in a down position (a), all the targets, A-D, are reset to move up (b). Once all the targets, A-D, are in an up position, three non-desired targets, B-D, are tripped to move down, thereby leaving the first A target up (c). Now, only the desired first target A is remaining in an up position (c). From there, the rest of the targets, B-D, are reset up (d). Now, all the targets, A-D, are in an up position (d). Again, three non-desired targets, A, C, and D are tripped to move down, thereby leaving the second target B up (e). It should also be noted that one reset coil is used to reset all targets up: (a) to (b). Three trip coils are used to trip the three non-desired targets: (b) to (c). One reset coil is used to reset the rest of the targets up: (c) to (d). Three trip coils are used to trip the three non-desired targets: (d) to (e). Therefore, the four step reset/trip operation by the traditional bank of individually trippable drop targets involves a total firing of eight coils (i.e., passing an electric current through the coils) in order to simulate the movement of the target from position A to position B.

Figure 8:
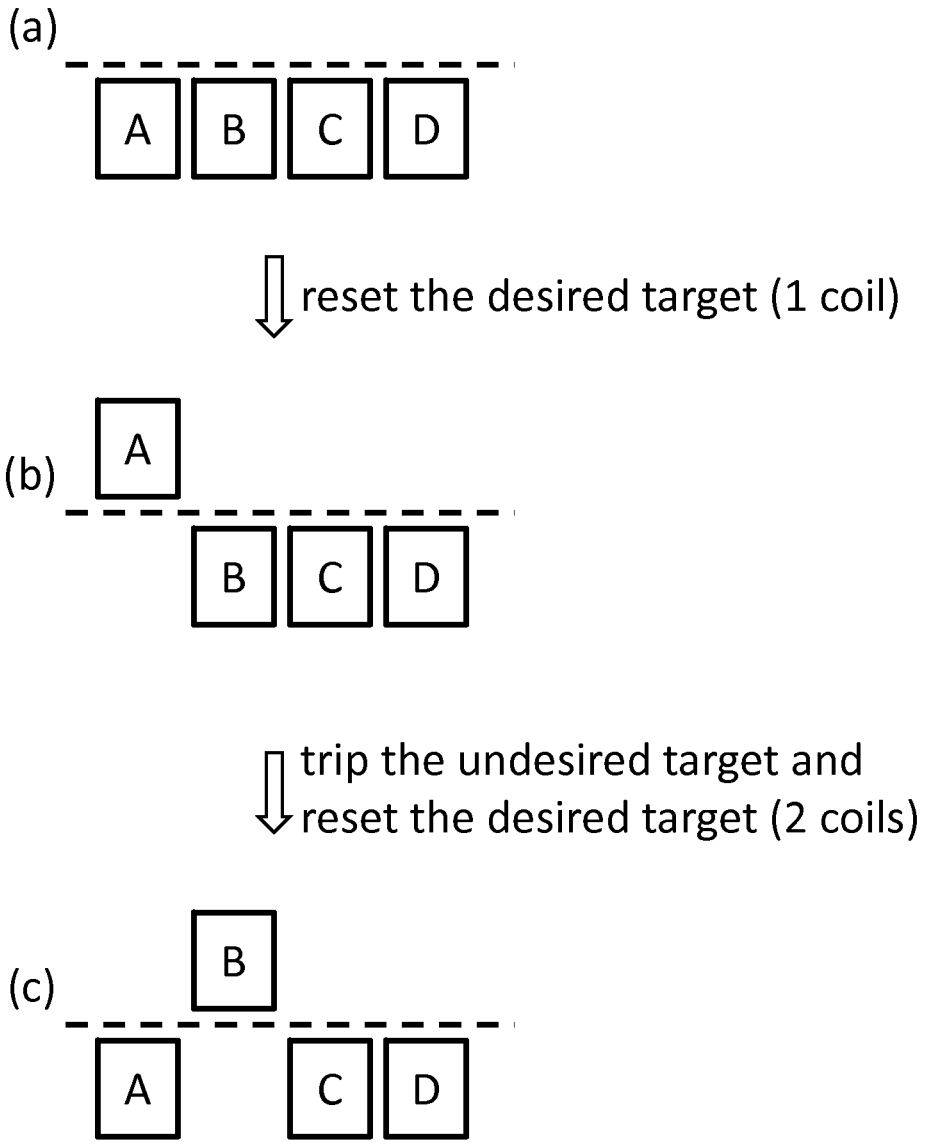
FIG. 8 is an example sequence of operations of a bank of individually trippable and resettable drop targets in accordance with an embodiment to simulate a movement of the targets.

FIG. 8 illustrates the steps required to simulate a movement of the target from position A to position B using a bank of individually trippable and resettable drop targets in accordance with an embodiment. To simulate a target moving across, a combination of "reset desired target" and "trip non-desired target" operations is performed. Where all targets begin in a down position (a), the desired target, A, is reset to move up (b). Once the desired target A is in an up position, then the standing target A, is tripped down, and another desired target B is reset up. Now, the desired target B is in an up position (c). It should also be noted that one reset coil is used to reset the desired target up: (a) to (b). One trip coil is used to trip the non-desired target, and one reset coil is used to reset the desired target up: (b) to (c). Therefore, the bank of individually trippable and resettable drop targets only needs two reset/trip operation steps, involving only a total of firing five coils, in order to simulate the movement of the target from position A to position B.

The advantage of a bank of individually trippable and resettable drop targets in accordance with an embodiment of the present disclosure over existing drop target banks is more prominent in more complex target movements. A game play, in which a movement of a hole (made up of two targets in the "down" state) in a wall is simulated in a bank of five targets, is used as a non-limiting example.

Figure 9:
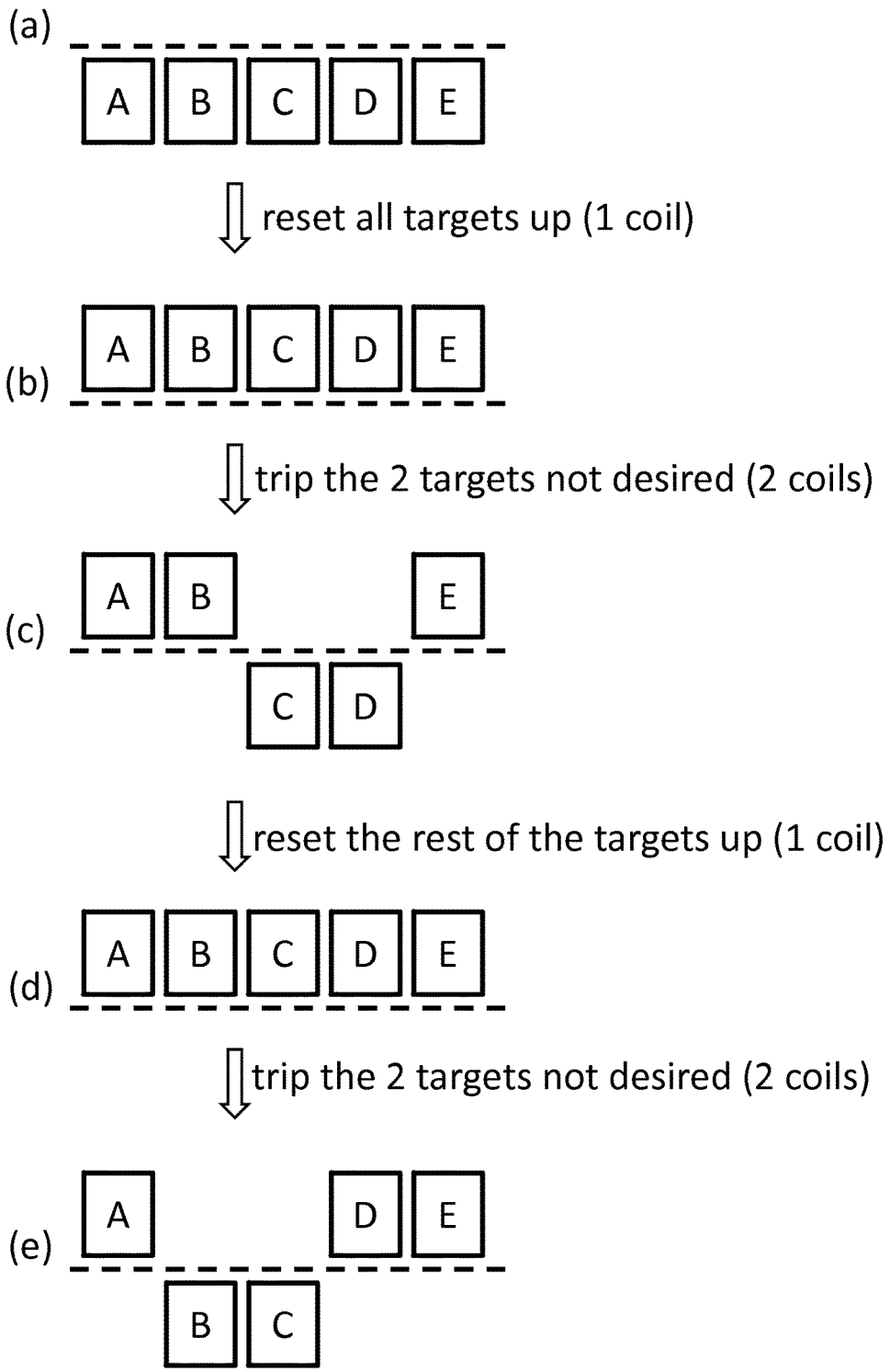
FIG. 9 is another example sequence of operations of a bank of individually trippable drop targets to simulate a movement of the targets.

FIG. 9 illustrates the steps required to simulate a movement of the hole from C-D to B-C using a traditional bank of individually trippable drop targets. To simulate a hole moving across a wall, a combination of a "reset all" and "trip not-desired target" operations is performed. Where all targets begin in a down position (a), the desired targets, A-E, are reset to move up (b). Once the desired targets A-E are in an up position, then two non-desired targets, C-D, are tripped down (c). Now, the desired targets A, B, and E targets are remaining in an up position (c). From there, all the targets A-E are reset up (d). Once the desired targets A-E are in an up position, then two non-desired targets, B-C, are tripped down (e). It should also be noted that one reset coil is used to reset all targets up: (a) to (b). Two trip coils are used to trip the two non-desired targets: (b) to (c). One reset coil is used to reset the rest of the targets up: (c) to (d). Two trip coils are used to trip the two non-desired targets: (d) to (e). Therefore, the four step reset/trip operation by the traditional bank of individually trippable drop targets involves a total firing of six coils (i.e., passing an electric current through the coils) in order to simulate a movement of the hole from C-D to B-C.

Figure 10:
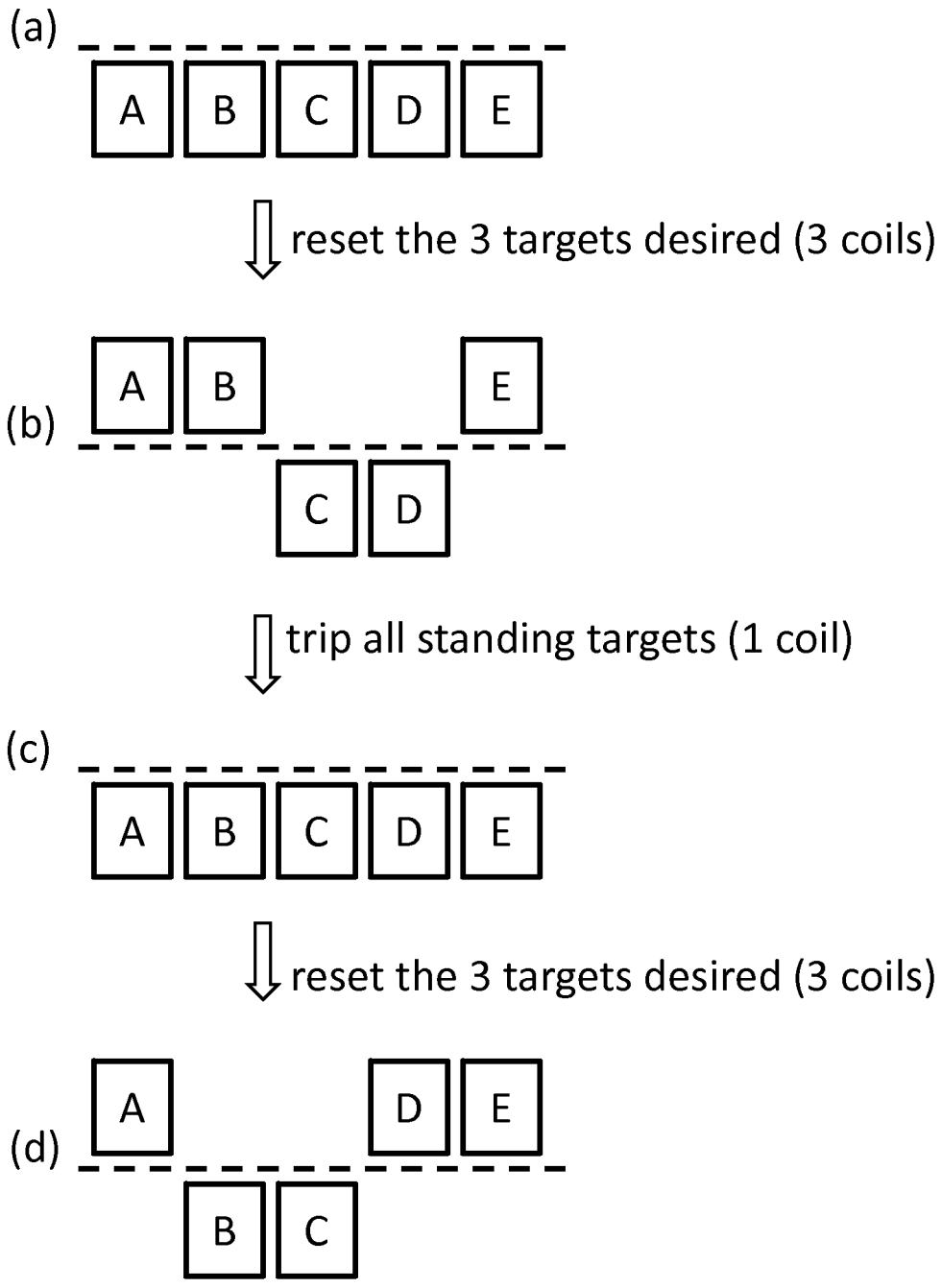
FIG. 10 is another example sequence of operations of a bank of individually resettable drop targets to simulate a movement of the targets.

FIG. 10 illustrates the steps required to simulate a movement of the hole from position C-D to position B-C using a traditional bank of individually resettable drop targets. To simulate a hole moving across a wall, a combination of a "reset desired target" and "trip all" operations is performed. Where all targets begin in a down position (a), the desired targets, A, B, and E, are reset to move up (b). Once the desired targets A, B, and E are in an up position, the targets A, B, and E are tripped back down (c). Now, all the targets are in a down position (c). From there, all newly desired targets A, D, and E are reset up (d). It should also be noted that three reset coils are used to reset three desired targets up: (a) to (b). One trip coil is used to trip all standing targets: (b) to (c). Three reset coils are used to reset three desired targets up: (c) to (d). Therefore, the four step reset/trip operation by the traditional bank of individually resettable drop targets involves a total firing of seven coils in order to simulate a movement of the hole from C-D to B-C.

Figure 11:
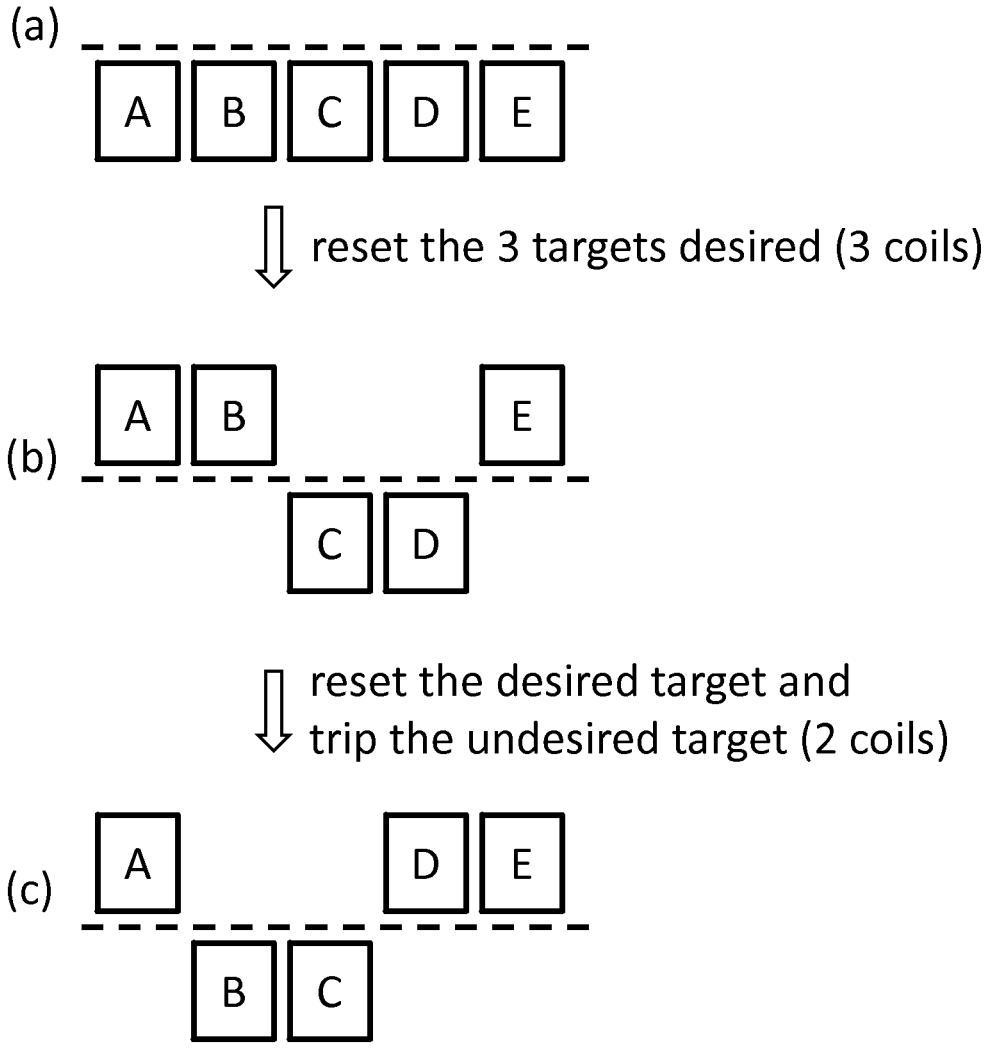
FIG. 11 is an example sequence of target drop-reset operations of a bank of individually trippable and resettable drop targets in accordance with an embodiment to simulate a movement of the targets.

FIG. 11 illustrates the steps required to simulate a movement of the hole from position C-D to position B-C using a bank of individually trippable and resettable drop targets in accordance with an embodiment. To simulate a target moving across, a combination of "reset desired target" and "trip non-desired target" operations is performed. Where all targets begin in a down position (a), the desired targets, A, B, and E, are reset to move up, while the undesired targets, C-D, remain down (b). From there, two individual drop targets switch places; for example, B is tripped down from an up position, while D is reset up from a down position. Now, the desired targets, A, D, and E, are in an up position (c). It should also be noted that three reset coils are used to reset the three targets desired: (a) to (b). One reset coil and one trip coil are used to reset the desired target and trip the undesired targets respectively: (b) to (c). Therefore, the bank of individually trippable and resettable drop targets only needs two reset/trip operation steps, involving only a total of firing five coils, in order to simulate the movement of the hole from C-D to B-C.

In addition to more efficient operations (fewer operation steps and fewer coil fires), a bank of individually trippable and resettable drop targets in accordance with an embodiment avoids unattractive "intermediate states" as shown in states (b) and (d) in FIG. 9 for the traditional bank of individually trippable drop targets; and state (c) in FIG. 10 for the traditional bank of individually resettable drop targets. Accordingly, there is no unattractive, unwanted intermediate state because the drop targets are placed where they are desired at a given time with a bank of individually trippable and resettable drop targets in accordance with an embodiment.

While the present disclosure has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the disclosure.

All examples and conditional language recited herein are intended for pedagogical purposes to aid the reader in understanding the principles of the disclosure and the concepts contributed by the inventor to furthering the art, and are to be construed as being without limitation to such specifically recited examples and conditions. Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. A drop target bank assembly comprising:

a plurality of drop target units mounted next to each other on a drop target bank bracket;

wherein each of the plurality of drop target units comprises:

a target;

a trip mechanism;

a reset mechanism; and a sensor;

wherein the trip mechanism is configured to move the target from a first position to a second position, and the trip mechanism is activated by a drive circuit;

wherein the reset mechanism is configured to move the target from the second position to the first position, and the reset mechanism is activated by the drive circuit;

wherein the sensor is configured to detect whether the target is at the first or second position;

wherein the trip mechanism in a drop target unit is individually activated independent of other trip mechanisms in other drop target units;

wherein the reset mechanism in a drop target unit is individually activated independent of other reset mechanisms in other drop target units; and wherein the drive circuit is controlled by a processor based on a signal from the sensor and a program, such that the drive circuit activates individually the trip mechanism and the reset mechanism in the plurality of drop target units according to a programmed sequence.

2. The assembly of claim 1, wherein the trip mechanism comprises:

a trip coil;

a trip arm; and an extension spring connected to the target;

wherein when a current passes through the trip coil, the trip coil actuates the trip arm to push the target off a ledge on which the target is resting, and the extension spring moves the target to the second position.

3. The assembly of claim 1, wherein the reset mechanism comprises:

a reset coil;

a plunger; and a reset bracket mounted to the plunger;

wherein when a current passes through the reset coil, the reset coil retracts the plunger, and the reset bracket moves up carrying the target to the first position.

4. The assembly of claim 1, wherein the sensor is an optical sensor.

5. The assembly of claim 1, wherein the sensor is a mechanical switch.

6. A drop target system comprising:

one or more drop target assemblies;

a processor; and a drive circuit;

wherein each of the one or more drop target assemblies comprises a plurality of drop target units mounted next to each other on a drop target bank bracket;

wherein each of the plurality of drop target units comprises:

a target;

a trip mechanism;

a reset mechanism; and a sensor;

wherein the trip mechanism is configured to move the target from a first position to a second position, and the trip mechanism is activated by the drive circuit;

wherein the reset mechanism is configured to move the target from the second position to the first position, and the reset mechanism is activated by the drive circuit;

wherein the sensor is configured to detect whether the target is at the first or second position;

wherein the trip mechanism in a drop target unit is individually activated independent of other trip mechanisms in other drop target units;

wherein the reset mechanism in a drop target unit is individually activated independent of other reset mechanisms in other drop target units; and wherein the processor is configured to receive a signal from the sensor and to control the drive circuit based on the signal and a program, such that the drive circuit individually activates the trip mechanism and the reset mechanism in each of the drop target units among the one or more drop target assemblies according to a programmed sequence.

7. The system of claim 6, wherein the trip mechanism comprises:

a trip coil;

a trip arm; and an extension spring connected to the target;

wherein when a current passes through the trip coil, the trip coil actuates the trip arm to push the target off a ledge on which the target is resting, and the extension spring moves the target to the second position.

8. The system of claim 6, wherein the reset mechanism comprises:

a reset coil;

a plunger; and a reset bracket mounted to the plunger;

wherein when a current passes through the reset coil, the reset coil retracts the plunger, and the reset bracket moves up carrying the target to the first position.

9. The system of claim 6, wherein the sensor is an optical sensor.

10. The system of claim 6, wherein the sensor is a mechanical switch.

11. A method of operating a drop target bank assembly comprising a plurality of drop target units mounted next to each other on a drop target bank bracket; wherein each of the plurality of drop target units comprises: a target; a trip mechanism; a reset mechanism; and a sensor; wherein the trip mechanism is configured to move the target from a first position to a second position, and the trip mechanism is activated by a drive circuit; the reset mechanism is configured to move the target from the second position to the first position, and the reset mechanism is activated by the drive circuit; the sensor is configured to detect whether the target is at the first or second position; wherein the drive circuit is controlled by a processor; wherein the trip mechanism in a drop target unit is individually activated independent of other trip mechanisms in other drop target units; and the reset mechanism in a drop target unit is individually activated independent of other reset mechanisms in other drop target units;

the method comprising:

receiving from the sensor in one of the plurality of drop target units a signal indicating whether the target in the one of the plurality of drop target units is at the first position or the second position; and individually activating the trip mechanism in the one of the plurality of drop target units to move the target from the first position to the second position or individually activating the reset mechanism in the one of the plurality of drop target units to move the target from the second position to the first position based on the signal a program, such that the targets in the plurality of drop target units move in accordance with a programmed sequence.

12. The method of claim 11, wherein the trip mechanism comprises: a trip coil; a trip arm; and an extension spring connected to the target;

the method further comprising passing a current through the trip coil, such that the trip coil actuates the trip arm to push the target off a ledge on which the target is resting, and the extension spring moves the target to the second position.

13. The method of claim 11, wherein the reset mechanism comprises: a reset coil; a plunger; and a reset bracket mounted to the plunger;

the method further comprising passing a current through the reset coil, such that the reset coil retracts the plunger, and the reset bracket moves up carrying the target to the first position.

14. The method of claim 11, the method further comprising coordinating a sequence of activations of the trip mechanism and reset mechanism among the plurality of the drop target units so as to simulate a dynamic movement of the targets in the drop target bank.

* * * * *